United States Patent [19]

Steele et al.

[11] Patent Number: 5,035,391

[45] Date of Patent: Jul. 30, 1991

[54] BALLOON ANCHOR

[76] Inventors: Dennis M. Steele; Diana C. Steele, both of Rte. 1, Box 25, Nofsger Rd., Lake Ann, Mich. 49650

[21] Appl. No.: 486,744

[22] Filed: Mar. 1, 1990

[51] Int. Cl.[5] ..... A47B 91/00

[52] U.S. Cl. ..... 248/346; 446/220

[58] Field of Search ..... 248/346, 910; 244/115, 244/31, 33, 904; 16/DIG. 8; 446/220; 40/659, 600, 611; 428/7

[56] References Cited

U.S. PATENT DOCUMENTS

| | | | |
|---|---|---|---|
| 1,392,622 | 10/1921 | Berry | 40/659 |
| 1,438,009 | 12/1922 | Averill | 40/659 |
| 2,210,155 | 6/1938 | Shera | 16/DIG. 8 X |
| 3,250,241 | 5/1966 | Levy | 446/220 X |
| 3,559,934 | 2/1971 | Jensen | 40/659 X |
| 3,941,384 | 3/1976 | Wopschall | 446/220 X |
| 4,159,587 | 7/1979 | Slavsky | 40/659 |

FOREIGN PATENT DOCUMENTS

| | | | |
|---|---|---|---|
| 432743 | 12/1911 | France | 244/115 |

*Primary Examiner*—J. Franklin Foss
*Attorney, Agent, or Firm*—Wallace J. Nelson

[57] ABSTRACT

A weighted anchor having a vertically extending bracket is employed to anchor one or more inflated balloons utilized as a balloon bouquet on festive occasions. The weighted anchor may be color coded for the occasion and may include suitable identifying indicia thereon. The vertically extending bracket includes a peripheral rim and one or more appendages vertically extending from the anchor. The peripheral rim and appendage(s) serve to receive attached tethers for the inflated balloon(s) and may also receive and frictionally retain an announcement card therebetween.

6 Claims, 1 Drawing Sheet

BALLOON ANCHOR

FIELD OF THE INVENTION

This invention relates to balloon anchors in general and relates specifically to balloon anchors for securely and releasably anchoring a bouquet or cluster of inflated decorative balloons employed as a gift or otherwise to celebrate a festive occasion.

BACKGROUND OF THE INVENTION

Bouquets of colorful, helium filled latex rubber or plastic balloons are frequently sent to individuals celebrating a birth, birthday, anniversary, promotion, retirement party, and the like, in lieu of or to supplement floral arrangements. A number of florists now offer this service in addition to their floral bouquets and other flower arrangements. These balloon bouquets must frequently be tied or anchored to various objects for display and retention thereof. Also, the usual announcement card, containing an appropriate message and identifying the recipient and sender, sometimes gets lost in the excitement surrounding the receipt of the gift. The present invention minimizes this problem.

It is therefore an object of the present invention to provide a small, simple anchor device for firmly, but releasably, attaching one or more tethered balloons thereto, while also providing a clip for retaining and visually displaying an announcement card.

Another object of the present invention to provide a novel anchor for releasably attaching one or more tethered, helium filled, balloons.

A further object of the present invention is an anchor for one or more tethered balloons having a clip for visually displaying an announcement card thereon.

An additional object of the present invention is an anchor for a bouquet of inflated balloons that releasably retains and displays the balloon bouquet.

A further object of the present invention is a color-coded decorative anchor for a gift bouquet of inflated balloons.

SUMMARY OF THE INVENTION

According to the present invention the foregoing and additional objects are attained by providing an anchor, including a weight member, formed of molded lead or similar heavy metal. The weight member is provided with a flat bottom surface and a decorative top and side surfaces. The decorative top and sides may be color coded with, or without, suitable indicia thereon to represent the occasion and/or the recipient of the balloon gift. A bracket is secured to, and vertically extends from, the top surface of the weight member. The bracket includes an open peripheral rim portion and a pair of vertical appendages extending from the upper surface of the weight member. The vertically extending appendages are normally retained within the confines of, and in the same vertical plane as, the open peripheral rim. A base portion of the bracket, including a portion of the open peripheral rim and a portion of the vertically extending appendages, is embedded within the weight member for permanent attachment thereof. Each member of the vertically extending appendages is provided with a curved open tip terminus. These termini and the open peripheral rim portion of the bracket serve as attachment structure for one or more tethered inflated balloons. The balloons are conventionally inflated with helium gas to maintain them suspended in elevated relationship to the anchor. The ends of the peripheral rim and vertical appendages are relatively separable from a common vertical plane by exerting relative force therebetween to permit the insertion and frictional retention of an announcement card, paper money or other suitable thin object by the slightly separated rim and appendages for display and delivery purposes.

BRIEF DESCRIPTION OF THE DRAWINGS

A more complete appreciation of the invention and many of the attendant advantages thereof will be more readily apparent as the same becomes better understood by reference to the following detailed description when considered in connection with the accompanying drawings wherein.

DETAILED DESCRIPTION

Figure 1:
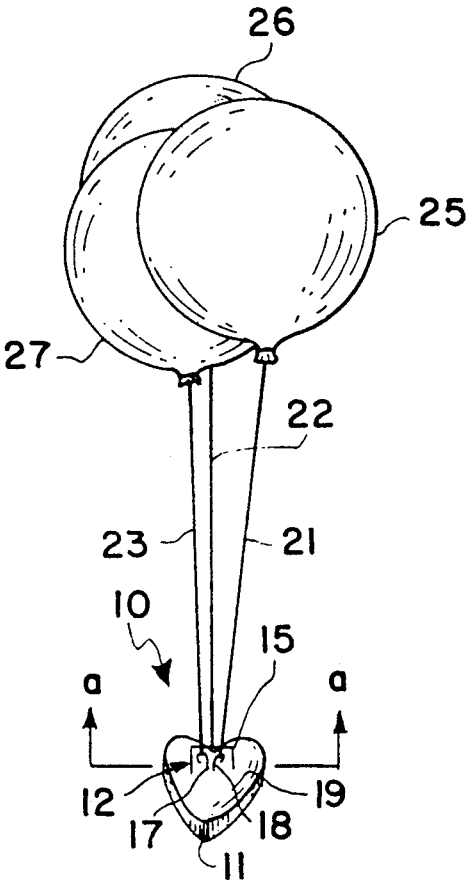
FIG. 1 is a view of one embodiment of the balloon anchor of the present invention with a bouquet of balloons releasably attached thereto.
Figure 1A:
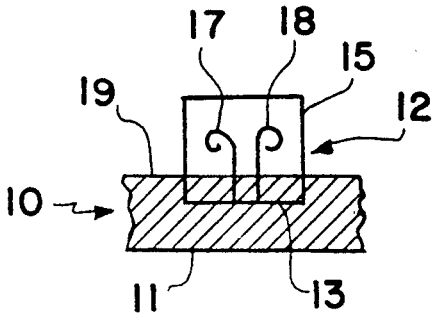
FIG. 1*a* is a sectional view of the balloon anchor taken along line a—a of FIG. 1.

Referring now to the drawings and more particularly to FIGS. 1 and 1*a*, the preferred embodiment of the balloon anchor of the present invention is shown and designated generally by reference numeral 10. Anchor 10 is formed of a heart-shaped relatively thin, block of lead or other heavy metal having a flat bottom surface 11. A bracket 12 is provided with a base portion 13 embedded or molded within anchor 10. A vertically extending peripheral rim portion 15 and a pair of appendages 17,18 extend vertically from the base portion 13 through the top surface 19 of anchor 10. Appendages 17,18 are provided with curved or looped open end termini and are normally contained within and in the same vertical plane as peripheral rim 15. Peripheral rim 15 and the termini of appendages 17,18 provide structure for tying or otherwise releasably attaching a plurality of tethers 21,22, and 23 for respective inflated balloons 25,26, and 27. The length of tethers 21,22 and 23 may vary and can be adjusted for the occasion, place of delivery and/or display. Normally, tethers 21,22 and 23 would be confined to a length that permits placing of anchor 10 on a desk or table for display of the balloon bouquet. Although three balloons 25,26 and 27 are shown in the illustrated embodiment, this number is not critical and may vary from a single balloon to a dozen or more, as so desired.

Figure 2:
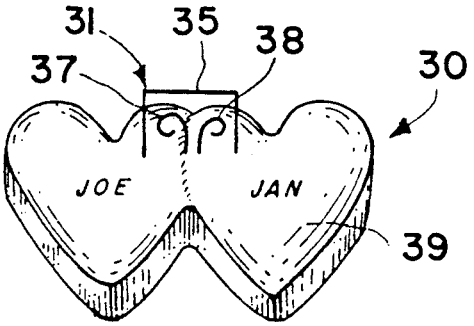
FIG. 2 is a view of another embodiment of the balloon anchor of the present invention.

Referring now to FIG. 2, an alternate embodiment of the balloon anchor of the present invention is illustrated and designated by reference numeral 30. As shown therein, anchor 30 is provided with a double or interlocking heart pair exterior design and includes a single bracket 31. Bracket 31 is of identical construction as that of bracket 12 described hereinbefore and includes open peripheral rim portion 35 and a pair of vertical appendages 37,38 extending vertically from the top surface 39 of anchor 30. The double or interlocking heart shaped anchor 30 is appropriate for engagements, weddings and anniversaries, whereas, the single heart anchor 20 illustrated in FIG. 1 may be more appropriate for births, birthdays, Valentines Day, or other individual greetings or congratulatory occasions.

Figure 3:
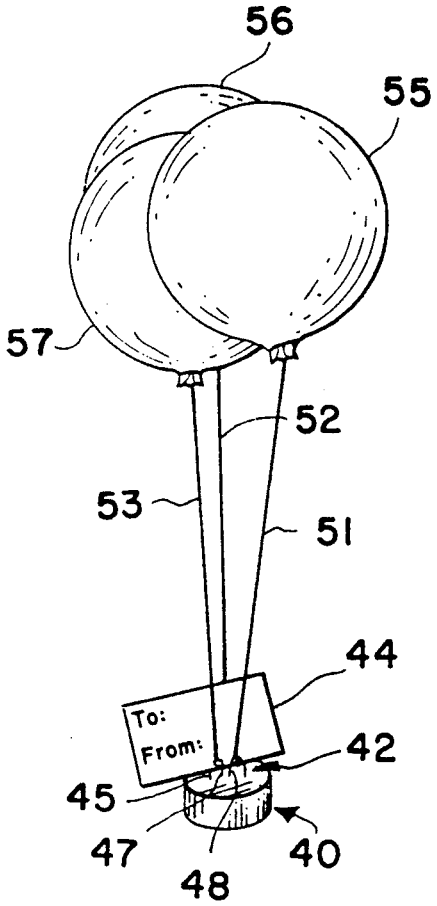
FIG. 3 is a view of a further embodiment of the balloon anchor of the present invention and illustrating the clip retention of an announcement card.

Referring now to FIG. 3, another embodiment of the balloon anchor of the present invention is illustrated and designated generally by reference numeral 40. As shown therein, anchor 40 is of a substantially flat disk configuration which is appropriate for any gift occasion. In this embodiment, the exposed ends of appendages 47,48 have been forced out of the same vertical plane as peripheral rim 45 to permit the insertion, and frictional retention of a suitable announcement, gift card, paper money, or other appropriate thin object, therebetween. In the illustrated embodiment tethers 51 and 53 for balloons 55 and 57 are tied or otherwise releasably secured to the termini of vertically extending appendages 47,48 while tether 52 for balloon 56 is secured to peripheral rim 45. Additional tethers could also be attached to appendages 47,48 and the open peripheral rim 45 of bracket 42, if so desired. As illustrated, card 44 is positioned between the tethers attached to open peripheral rim 45 and those attached to the vertical appendages 47,48.

Although the invention has been described relative to specific embodiments thereof, it is not so limited and there are numerous variations and modifications thereof that will be readily apparent to those skilled in the art in the light of the above teachings. For example, the brackets employed in the various embodiments may have a different structure and configuration other than the inverted square bottom U-configuration as described and shown in the embodiments of FIGS. 1–3. Also, the peripheral rim and the vertically extending appendages may be separate structures and not attached to a common base as described herein. In addition, the vertical appendages are not limited to the two shown and described but may consist of one, three or more if so desired and be provided with different structured termini than that described and illustrated herein for the preferred embodiments. Suitable indicia, such as that illustrated in FIG. 2, may be employed on each of the embodiments described herein in addition to, or in lieu of, the announcement card. This indicia may be hand printed, in script, or provided on suitable stickers attached to the anchor, as so desired.

The top or exterior surfaces of each balloon anchor of the present invention is provided with a decorative color paint. The anchors may be color-coded when so desired, for example pink or blue, to honor the birth of a baby girl or boy.

The preferred material for making the balloon anchors of the present invention is lead although other heavy weight material may be employed as long as the material selected is adequate to retain the number of balloons in the bouquet anchored. Although three balloons are shown in the illustrated embodiments, the anchors of the present invention described herein are suitable for anchoring any number, from one to a dozen or more, of helium filled latex or Mylar balloons. The size of the lead anchors also may vary and in the preferred embodiments, the diameter of disk anchor 40 shown in FIG. 3 is in the range of one to one and three-eighths inch, the single heart anchor 10, of FIG. 1 has dimensions in both horizontal directions in the same range, while the double or interlocked heart anchor 30 illustrated in FIG. 2 has a length of approximately two and one-quarter inches. In each of the embodiments described, the anchors have a thickness of in the range of one-quarter and one-half inch. These dimensions are not considered critical and may be varied without departing from the spirit and scope of the invention.

No specific material has been mentioned for constructing the bracket members, it being understood that any suitable wire, spring steel or similar material having the required physical property characteristics to withstand the fabrication procedure, may be employed as long as the final structure has adequate strength to permit attachment and retention of multiple tethers thereto and the flexibility necessary to frictionally retain an announcement card, paper money or other thin object between the peripheral rim and the vertical appendages. When the inflated balloons lose their inflation medium or when the recipient tires of the display, the tethers may be removed and the anchor employed as a decorative desk paper weight with the clip structure thereon serving as suitable retaining structure for telephone messages, mail, or the like.

These and other variations and modifications of the present invention will be readily apparent to those skilled in the art in the light of the above teachings.

It is therefore to be understood that, within the scope of the appended claims, the invention may be practiced other than as specifically described.

What is claimed as new and desired to be secured by Letters Patent of the United States is:

1. The combination of at least one inflated, tethered, decorative party balloon and anchor means therefor; the improvement therewith comprising:

said anchor means being a weight member having a bracket secured to and vertically extending therefrom, said bracket including an open peripheral rim portion and at least one vertical appendage extending from said weight member and normally disposed within the confines of said open peripheral rim, said at least one vertical appendage having a base portion secured to said weight member and a terminus spaced from said open peripheral rim portion of said bracket, said peripheral rim and said terminus of said at least one vertical appendage being normally disposed in a common vertical plane and being relatively separable along a portion of the plane to permit the insertion and frictional retention of a card member therebetween, and said peripheral rim serving as a connection structure for attaching at least one inflated, tethered, decorative party balloon to said weight member.

2. The combination of claim 1 wherein said at least one vertical appendage extending from said weight member includes a pair of identical appendages, each member of said pair of identical appendages being provided with an open tip terminus, and said open tip termini serving as connection structure for releasably connecting at least one tether to secure at least one inflated, decorative party balloon to said weight member, said bracket having portions thereof embedded within and permanently secured to said weight member.

3. The combination of claim 2 wherein said weight member is color coded for the festive occasion for the said at least one inflated, decorative party balloon and including identifying indicia on said weight member.

4. The combination of a bouquet of inflated, decorative party balloons and an anchor releasably connected thereto; the improvement therewith comprising:

said anchor being a substantially flat weighted member, bracket means vertically extending from said weighted member, said bracket means including clip structure for visually displaying and frictionally retaining a card, structure provided on said bracket means for releasably securing tethers for a bouquet of inflated, decorative party balloons thereto.

5. The combination of claim 4 wherein said structure provided on said bracket means for releasably securing the tethers for a bouquet of inflated, decorative party balloons thereto includes an open peripheral rim, at least one vertically disposed appendage extending from said weighted member and disposed within the confines and along the same vertical plane as said open peripheral rim, said open peripheral rim and said at least one vertically disposed appendage including relatively bendable parts to permit the insertion and frictional retention of a card therebetween for visually displaying the card on said weighted member, said at least one vertically disposed appendage including a pair of spaced, identical appendages, each member of said pair of spaced identical appendages having an open loop terminus and said open loop termini being portions of said structure provided on said bracket means for releasably securing tethers for a bouquet of inflated, decorative party balloons.

6. The combination of claim 4 wherein said weighted member comprises a molded lead weight, identifying indicia provided on said molded lead weight, and said bracket means having portions thereof embedded within said molded lead weight for permanent attachment of said bracket to said molded lead weight.

* * * * *